US011452316B2

(12) United States Patent
Lee

(10) Patent No.: US 11,452,316 B2
(45) Date of Patent: Sep. 27, 2022

(54) NON-BINDING-MARK SOCK

(71) Applicant: Lace Poet, Inc., Victoria, TX (US)

(72) Inventor: Kung-Yuan Lee, Taipei (TW)

(73) Assignee: LACE POET, INC., Victoria, TX (US)

( * ) Notice: Subject to any disclaimer, the term of this patent is extended or adjusted under 35 U.S.C. 154(b) by 64 days.

(21) Appl. No.: 16/894,430

(22) Filed: Jun. 5, 2020

(65) Prior Publication Data

US 2020/0383387 A1 Dec. 10, 2020

(30) Foreign Application Priority Data

Jun. 6, 2019 (TW) ..... 108207288

(51) Int. Cl.
*A41B 11/12* (2006.01)

(52) U.S. Cl.
CPC ..... *A41B 11/123* (2013.01); *A41B 11/121* (2013.01); *A41B 11/126* (2013.01)

(58) Field of Classification Search
CPC ..... A41B 11/12; A41B 11/121; A41B 11/123; A41B 11/126
USPC ..... 2/239, 240, 241
See application file for complete search history.

(56) References Cited

U.S. PATENT DOCUMENTS 1,017,310 A * 2/1912 Newman ..... A41B 11/12 2/240
1,083,735 A * 1/1914 Foster ..... A41B 11/12 2/240
1,213,047 A * 1/1917 Werm ..... A41B 11/12 2/240
1,317,876 A * 10/1919 Hruby ..... A41B 11/12 2/240
1,644,185 A * 10/1927 Fischer ..... A41B 11/12 2/240
1,880,086 A * 9/1932 Gosch ..... D04B 9/54 66/173
1,944,591 A * 1/1934 Brown ..... A41B 11/12 66/173
1,968,967 A * 8/1934 Snader ..... A41B 11/01 2/239
1,992,680 A * 2/1935 Talmadge ..... D05B 93/00 112/415
1,995,261 A * 3/1935 Gidney ..... A41B 11/12 2/240
1,996,648 A * 4/1935 Lawson ..... D04B 1/26 66/172 E (Continued)

FOREIGN PATENT DOCUMENTS

WO WO-2008105003 A1 * 9/2008 ..... D06M 13/355
WO WO-2018226194 A1 * 12/2018 ..... A41B 11/128

*Primary Examiner* — Jocelyn Bravo
(74) *Attorney, Agent, or Firm* — Muncy, Geissler, Olds & Lowe, P.C.

(57) ABSTRACT

A non-binding-mark sock is provided, including a sock sole and a straight sock leg connected to each other, where the upper portion of the straight sock leg is an opening end. An inner surface of the straight sock leg has at least one transverse annular convex portion near the opening end, where the transverse annular convex portion is sewn by a thread, a plurality of convex segments are formed on an inner surface of the transverse annular convex portion along the thread, and the convex segments protrude from the inner surface of the straight sock leg.

1 Claim, 4 Drawing Sheets

(56) References Cited

U.S. PATENT DOCUMENTS 2,035,469 A * 3/1936 Gaines ..... A41B 11/12 2/240
2,040,562 A * 5/1936 Meinig ..... A41B 11/12 2/240
2,049,803 A * 8/1936 Hardie ..... A41B 11/12 2/240
2,065,936 A * 12/1936 Hardie ..... A41F 9/02 2/240
2,066,282 A * 12/1936 Van Voorhis ..... A41B 11/12 2/240
2,084,938 A * 6/1937 Busch ..... A41B 11/12 2/240
2,088,943 A * 8/1937 Botts ..... A41B 11/12 66/183
2,169,203 A * 8/1939 Hinehliff ..... D04B 9/46 66/178 A
2,190,560 A * 2/1940 Gaines ..... D04B 9/54 66/172 E
2,208,991 A * 7/1940 Lewis ..... A41B 11/00 2/240
2,218,269 A * 10/1940 Shelton ..... A41B 11/12 2/239
2,220,803 A * 11/1940 Lesher ..... A41B 11/12 66/172 E
2,244,871 A * 6/1941 Guinzburg ..... A41D 13/065 2/59
2,349,746 A * 5/1944 Morris ..... D04B 1/26 66/172 E
2,494,927 A * 1/1950 Burd ..... A41B 11/12 2/239
2,514,108 A * 7/1950 Vogt ..... A41B 11/128 2/240
2,571,543 A * 10/1951 Connor ..... A41B 11/00 2/240
2,729,825 A * 1/1956 Rosecrans, Sr. ..... A41B 11/12 2/312
2,748,397 A * 6/1956 Stolzenberg ..... A41B 11/12 2/240
2,837,747 A * 6/1958 Schafler ..... A41B 11/12 2/240
2,918,679 A * 12/1959 Bell ..... A41B 11/12 2/240
2,977,782 A * 4/1961 Sheek ..... A41B 11/12 66/173
3,253,599 A * 5/1966 Bjorn-Larsen ..... A41B 11/128 450/104
3,334,634 A * 8/1967 Jones ..... A41B 11/12 450/111
3,359,571 A * 12/1967 Jamesf ..... A41F 11/18 2/409
3,389,722 A * 6/1968 Howard ..... D03D 15/56 139/423
3,487,662 A * 1/1970 Safrit ..... A41F 11/18 66/173
3,577,993 A * 5/1971 Gluckin ..... A41F 11/18 450/111
3,590,390 A * 7/1971 Howard ..... A41B 11/126 2/312
3,590,823 A * 7/1971 Pope, Jr. ..... A41F 11/18 450/95
3,729,956 A * 5/1973 Nebel ..... D04B 1/26 66/172 E
3,800,331 A * 4/1974 Taddeo ..... A41B 11/12 2/240
3,854,978 A * 12/1974 Campbell, Sr. ..... D06N 7/0092 427/375
3,874,001 A * 4/1975 Patience ..... A61F 13/08 2/240
4,178,924 A * 12/1979 Baxter ..... A61F 15/004 602/3
5,027,440 A * 7/1991 Morris ..... A41B 11/006 2/239
5,097,537 A * 3/1992 Ewing ..... A41B 11/003 2/239
5,497,513 A * 3/1996 Arabeyre ..... A61F 13/08 2/16
5,593,453 A * 1/1997 Ahlert ..... A61F 2/78 2/270
5,653,128 A * 8/1997 Warren, Jr. ..... A41B 11/121 2/239
6,673,421 B1 * 1/2004 Andrews ..... A41B 11/04 2/239
7,748,240 B1 * 7/2010 Cherneski ..... D04B 1/26 66/185
7,867,179 B2 * 1/2011 Bindas ..... A61F 15/004 602/3
8,176,864 B2 * 5/2012 Angelino ..... D06M 23/18 112/475.09
8,523,713 B2 * 9/2013 Roman ..... A41D 1/08 473/438
9,345,271 B2 * 5/2016 Collins ..... A41B 11/00
9,539,119 B2 * 1/2017 Sauer ..... A61F 2/78
10,165,803 B2 * 1/2019 Hoeven ..... A41C 3/065
10,428,447 B2 * 10/2019 Tuerk ..... A61F 13/08
2007/0033711 A1 * 2/2007 Achtelstetter ..... D04B 1/26 2/239
2007/0283483 A1 * 12/2007 Jacober ..... D04B 1/265 2/239
2008/0244801 A1 * 10/2008 Russo ..... A63B 71/081 2/22
2012/0116282 A1 * 5/2012 Cros ..... D04B 1/265 602/76
2014/0331386 A1 * 11/2014 Taylor ..... A41B 11/003 2/239
2018/0352896 A1 * 12/2018 Rodger ..... A41B 11/00
2019/0281901 A1 * 9/2019 Jacobson ..... A41B 11/003
2019/0298583 A1 * 10/2019 Hoffeins ..... A61F 13/0269
2019/0364999 A1 * 12/2019 Baschak ..... A41D 1/089
2020/0237023 A1 * 7/2020 Miller ..... A43B 23/28
2020/0308738 A1 * 10/2020 Lineberry ..... A41B 11/126
2020/0337385 A1 * 10/2020 Scott ..... A43B 1/10

* cited by examiner

NON-BINDING-MARK SOCK

RELATED APPLICATIONS

This application claims priority to Taiwan Patent Application No. 108207288, filed Jun. 6, 2020, the entirety of which is herein incorporated by reference.

BACKGROUND

Field of Invention

This present invention relates to a type of socks, in particular to non-binding-mark socks.

Description of Related Art

People wear socks on their feet and legs to protect and keep them warm.

The legs shape is generally from a lower thin portion to an upper thick portion. Therefore, strap-fix structures are required for opening ends of sock tops, or otherwise the sock tops are prone to slide down along the legs due to above-mentioned leg shape.

The strap-fix structure of conventional socks has binding bands at the opening ends of sock leg tops, which are used to strap and fix the sock leg tops tightly on a user's legs by means of the binding force of the binding bands, thus preventing the sock legs from sliding down. However, it will cause binding marks on user legs and block the smooth blood flow when the binding bands are too tight, while the binding bands cannot effectively fix on legs if bound loosely. The sock leg tops are still prone to slip down.

In addition, some manufacturers have a number of silica gel particles melted and adhered to inner surfaces of the opening ends of the sock leg tops to generate friction resistance between socks and user legs and to prevent the sock leg tops from sliding down. However, silica gel particles are chemicals which would cause discomfort and injury to the skin of the user legs upon long-term usage and contact.

SUMMARY

This present disclosure provides a non-binding-mark sock tightly fixed without causing discomfort and injury to user leg.

According to one aspect of this present disclosure, a non-binding-mark sock is provided, including a sock sole and a straight sock leg connected to each other, where the upper portion of the straight sock leg is an opening end. An inner surface of the straight sock leg has at least one transverse annular convex portion near the opening end, where the transverse annular convex portion is sewn by a thread, a plurality of convex segments are formed on an inner surface of the transverse annular convex portion along the thread, and the convex segments protrude from the inner surface of the straight sock leg.

According to an embodiment of this present disclosure, the thread is an elastic thread stitched onto the inner surface of the straight sock leg along an annular orientation by using a left suture and a right suture in a pattern of overlock stitch, so as to form the transverse annular convex portion and the convex segments thereof.

According to the non-binding-mark sock of this present disclosure, since the inner surface of the straight sock leg is provided with a plurality of annular convex portions, and each of the annular convex portions has an extremely large number of convex segments and crosses at right-angle with each straight sock leg in the sock wearing direction. Therefore, when the sock are worn on the leg, the straight sock leg can generate friction resistance with the user leg due to the plurality of convex segments, thereby preventing the straight sock leg from sliding down without leaving binding marks on the user leg.

DETAILED DESCRIPTION

The aforementioned and further technical contents, features and effects of this present invention will be apparent from the following detailed description of the embodiments with reference to the drawings.

Figure 1:
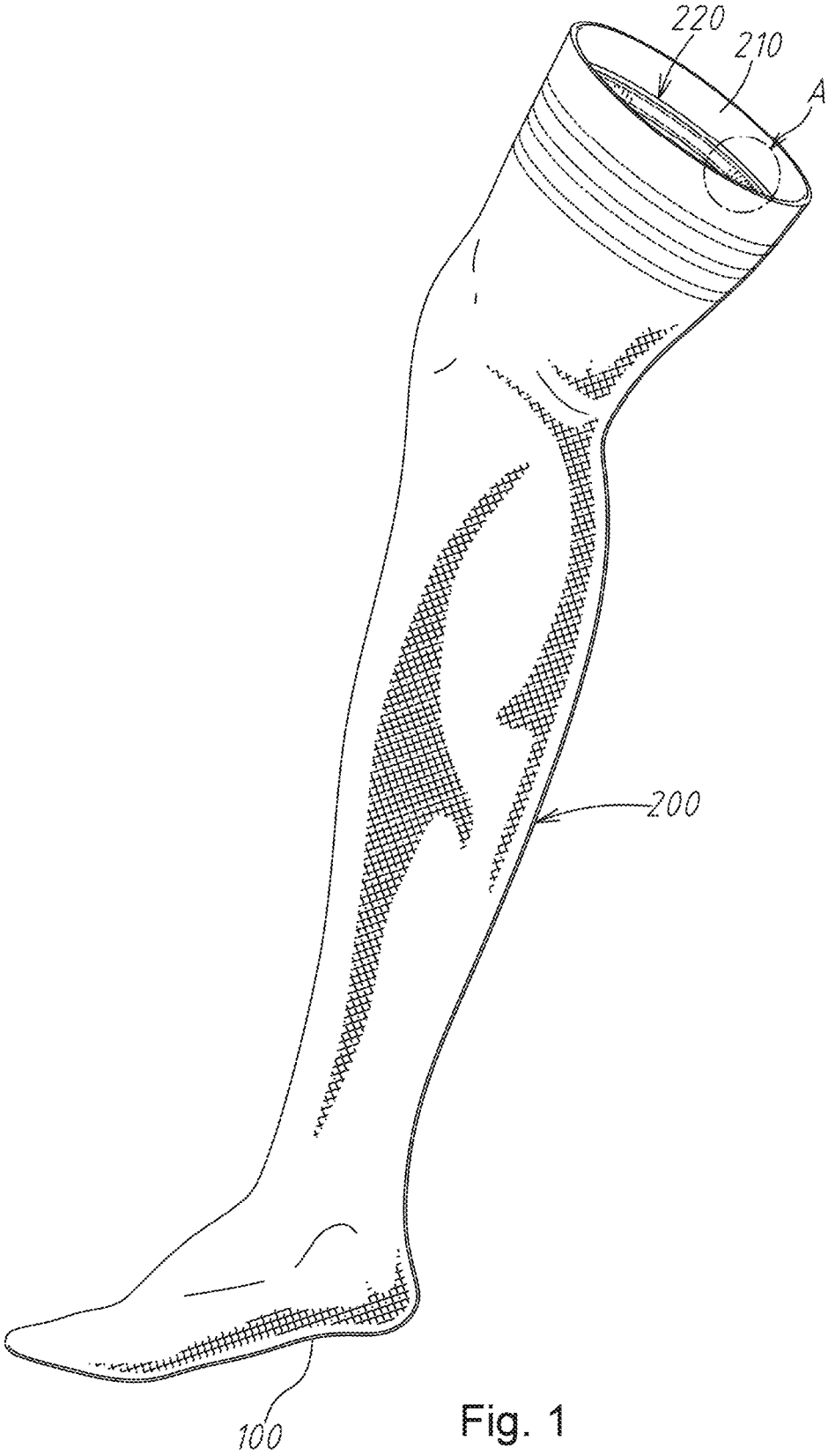
FIG. 1 is a diagram depicting the appearance of a non-binding-mark sock according to an embodiment of this present disclosure.
Figure 2:
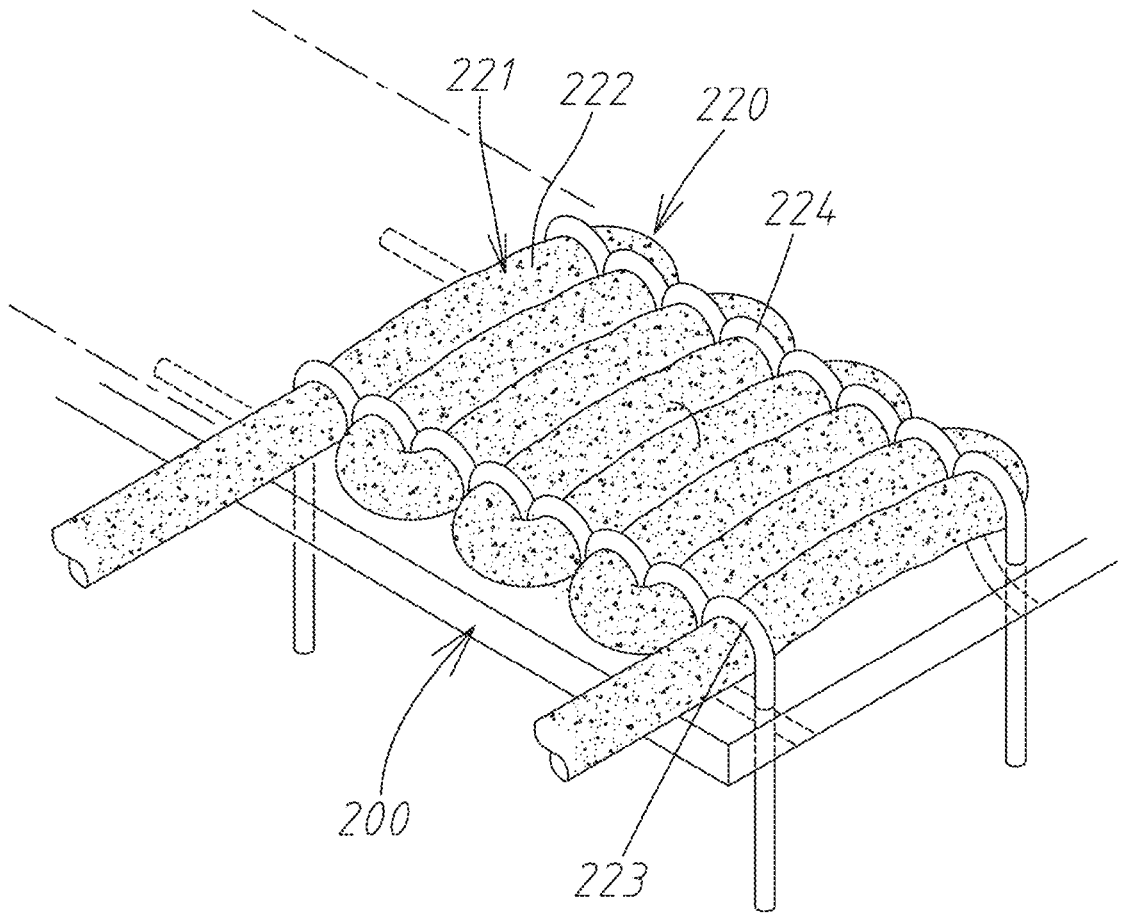
FIG. 2 is an enlarged view depicting the part A of the non-binding-mark sock shown in FIG. 1.
Figure 3:
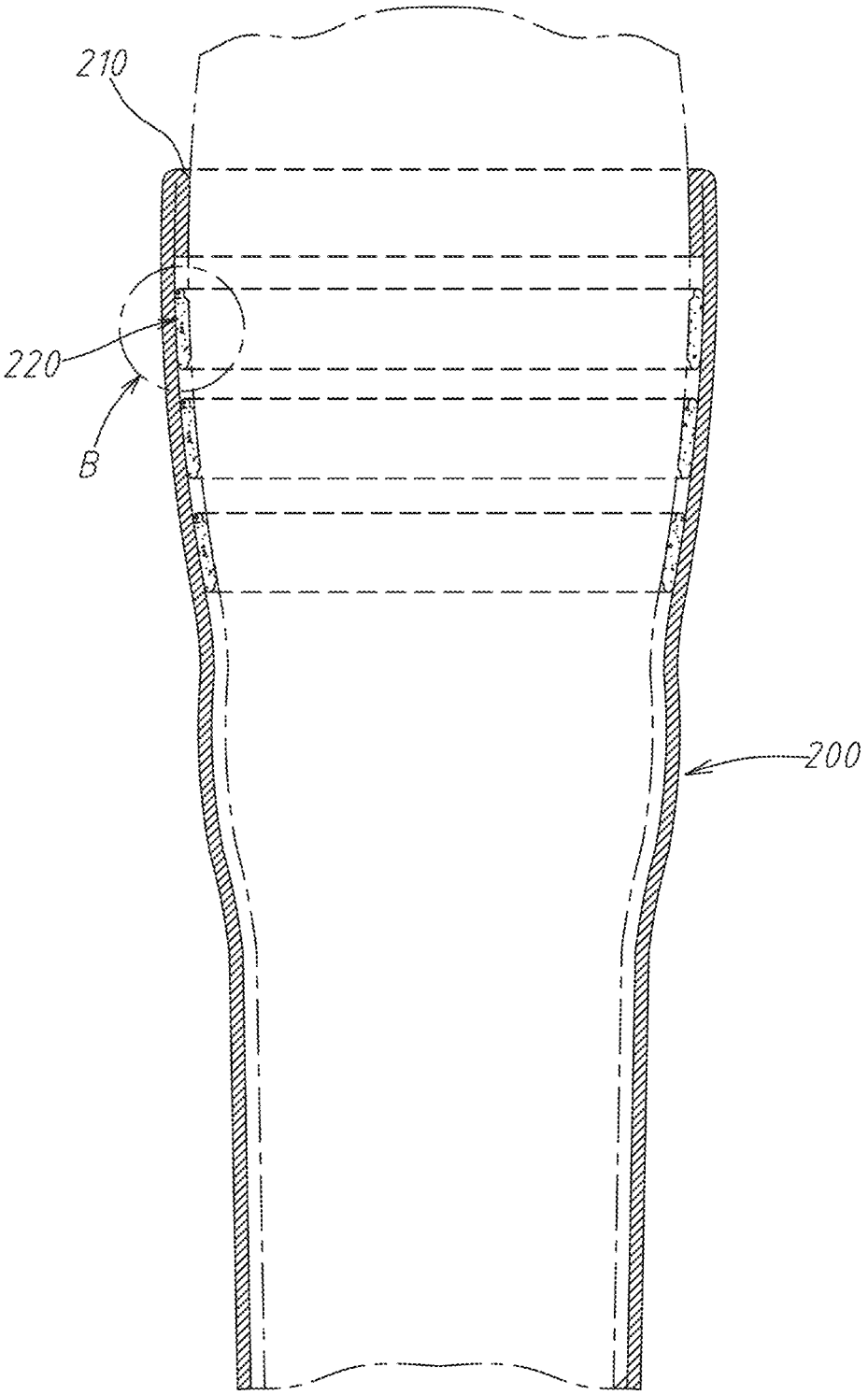
FIG. 3 is a partial cross-sectional view depicting the non-binding-mark sock shown in FIG. 1.
Figure 4:
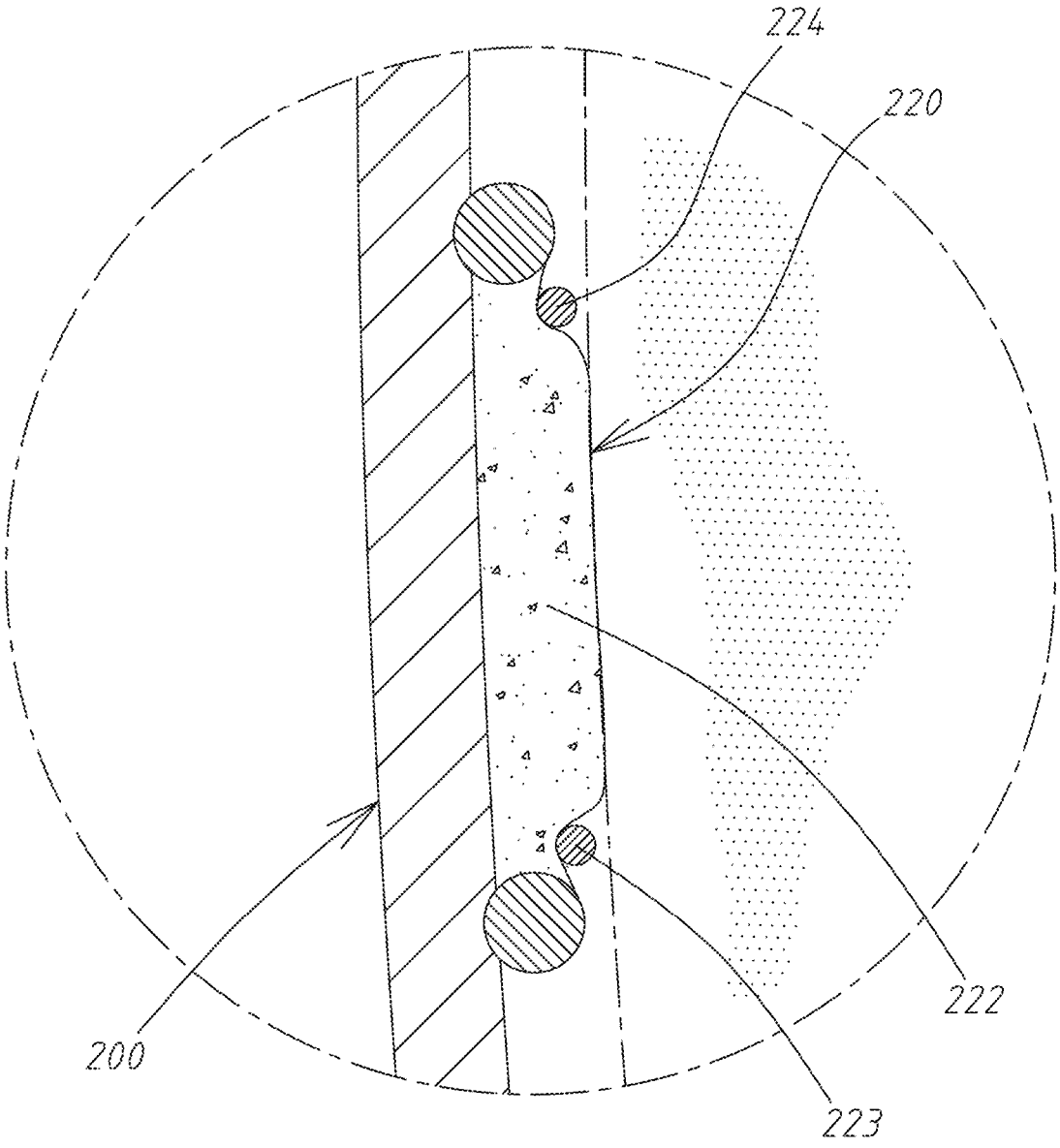
FIG. 4 is an enlarged view showing part B of the non-binding-mark sock shown in FIG. 3.

Referring to FIGS. 1 to 4, a non-binding-mark sock according to an embodiment of this present disclosure includes a sock sole 100 and a straight sock leg 200 connected to each other. The upper portion of the straight sock leg 200 is an opening end 210 where a foot enters when wearing socks. During wearing, the sock sole 100 and the straight sock leg 200 are respectively corresponding to the user foot and leg. The length of the straight sock leg 200 is not limited, and may be a short sock at the ankle of the user, or a middle sock below the knee of the user, or a long sock above the knee of the user.

The inner surface of the straight sock leg 200 has three transverse annular convex portions 220 near the open end 210. The annular convex portions are sewn by using threads 221. The threads are elastic threads 221 and stitched onto the inner surface of the straight sock leg 200 along the annular orientation by using a left suture 223 and a right suture 224 in the pattern of overlock stitch, so as to form the annular convex portions 220. In addition, a number of convex segments 222 are naturally formed on the inner surface of the straight sock leg 200 along the stitched elastic threads, where convex segments 222 protrude from the inner surface of the straight sock leg 200.

According to the non-binding-mark sock of the present disclosure, since the inner surface of the straight sock leg 200 has a plurality of annular convex portions 220, and each of the annular convex portions 220 has an extremely large number of convex segments 222 and crosses at a right angle with the straight sock leg 200 in the sock wearing direction. Therefore, when the user wears the sock of the present disclosure, the straight sock leg 200 can generate friction resistance with the user leg due to the plurality of convex segments 222, thereby preventing the straight sock legs from sliding down. Further, the non-binding-mark sock of the present disclosure leaves no binding mark on the user legs due to the friction resistance caused by the plurality of convex segments 222 that stops the sock leg 200 from sliding down, without transverse binding force applied on the user legs caused by binding bands.

Although this present disclosure has been disclosed by way of example, it is not intended to limit this present invention. Any person skilled in the art may make various changes and modifications without departing from the spirit and scope of this present disclosure. Therefore, the scope of protection of this present disclosure shall be as defined in the appended claims.

What is claimed is:

1. A non-binding-mark sock, comprising:

a sock sole; and a straight sock leg connected to the sock sole, an upper portion of the straight sock leg being an opening end, an inner surface of the straight sock leg having at least one transverse annular convex portion near the opening end, the at least one transverse annular convex portion formed by an elastic zigzag thread, the at least one transverse annular convex portion forming a plurality of convex segments and a plurality of U-shaped ends on an inner surface of the at least one transverse annular convex portion along the elastic zigzag thread, and the convex segments protruding from the inner surface of the straight sock leg, wherein the elastic zigzag thread is stitched onto the inner surface of the straight sock leg along an annular orientation by sutures of additional threads to fix the U-shaped ends of the elastic zigzag thread on the inner surface of the straight sock leg and the elastic zigzag thread does not form stitches itself, so as to form the at least one transverse annular convex portion and the convex segments of the at least one transverse annular convex portion, wherein the convex segments of the at least one transverse annular convex portion are transversely located on the inner surface of the straight sock leg, each of the convex segments extends up and down, and the convex segments are arranged in parallel and formed by the elastic zigzag thread only.

* * * * *